US007386900B2

(12) United States Patent
Lemire

(10) Patent No.: US 7,386,900 B2
(45) Date of Patent: Jun. 17, 2008

(54) PATIENT SUPPORT DECK LIFTING/LOWERING ASSEMBLY

(75) Inventor: Guy Lemire, Beaumont (CA)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 11/605,126

(22) Filed: Nov. 28, 2006

(65) Prior Publication Data

US 2007/0067912 A1 Mar. 29, 2007

Related U.S. Application Data

(62) Division of application No. 10/902,519, filed on Jul. 29, 2004, now Pat. No. 7,150,056.

(51) Int. Cl.
*A61G 13/06* (2006.01)

(52) U.S. Cl. ..... 5/611; 5/11; 5/600

(58) Field of Classification Search ..... 5/611, 5/11, 600; 318/280, 283; 348/837; 254/89 R, 254/89 H, 93 L, 93 R, 5 C
See application file for complete search history.

(56) References Cited

U.S. PATENT DOCUMENTS 5,135,350 A 8/1992 Eelman et al.
5,365,622 A * 11/1994 Schirmer ..... 5/611
5,732,425 A 3/1998 Leung
5,862,549 A 1/1999 Morton et al.
2007/0169268 A1 7/2007 Lemire et al.

* cited by examiner

*Primary Examiner*—Patricia Engle
*Assistant Examiner*—Fredrick Conley
(74) *Attorney, Agent, or Firm*—Van Dyke, Gardner, Linn & Burkhart, LLP

(57) ABSTRACT

A frame elevating mechanism having first and second frames vertically spaced from one another. The first frame is configured to be supported on a floor surface. The second frame has a pair of longitudinally spaced elongate guide tracks extending coextensively with each lateral side of the second frame. Lever arms are provided on the first frame and include at the distal ends thereof a follower member operatively coupled to a respective one of the guide tracks. Each of the aforesaid lever arms has thereon an elongate second guide track configured to receive thereon a distal end of one of the arms of a two arm lever pivotally mounted on the first frame. Drive mechanisms are provided which operatively engage the second arm of the two arm lever to effect a change in elevation of the second frame relative to the first frame.

20 Claims, 7 Drawing Sheets

PATIENT SUPPORT DECK LIFTING/LOWERING ASSEMBLY

CROSS-REFERENCE TO RELATED APPLICATION

This is a division of U.S. Ser. No. 10/902,519, filed Jul. 29, 2004, now U.S. Pat. No. 7,150,056.

FIELD OF THE INVENTION

This invention relates to a frame elevating mechanism and, more particularly, to a frame elevating mechanism for use on a bed.

BACKGROUND OF THE INVENTION

In the field of patient care, it is often necessary to raise and lower the patient support deck on a bed. Various frame elevating mechanisms have been developed but are generally unacceptable because the patient support deck shifts toward either the head end or the foot end of the bed as the bed elevation is changed.

Accordingly, it is an object of this invention to provide a frame elevating mechanism that moves the frame so that the head end and the foot ends of the frame travel in a vertical plane.

It is a further object of the invention to provide a frame elevating mechanism, as aforesaid, which is inexpensive to manufacture and is of a durable construction.

SUMMARY OF THE INVENTION

The objects and purposes of the invention are met by providing a frame elevating mechanism having first and second frames vertically spaced from one another. The first frame is configured to be supported on a floor surface. The second frame is oriented above the first frame and has a pair of longitudinally spaced elongate guide tracks extending coextensively with each lateral side of the second frame. Lever arms are provided on the first frame and include at the distal ends thereof a follower member operatively coupled to a respective one of the guide tracks. Each of the aforesaid lever arms has thereon an elongate second guide track configured to receive thereon a distal end of one of the arms of a two arm lever pivotally mounted on the first frame. Drive mechanisms are provided which operatively engage the second arm of each of the two arm levers to effect a change in elevation of the second frame relative to the first frame.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
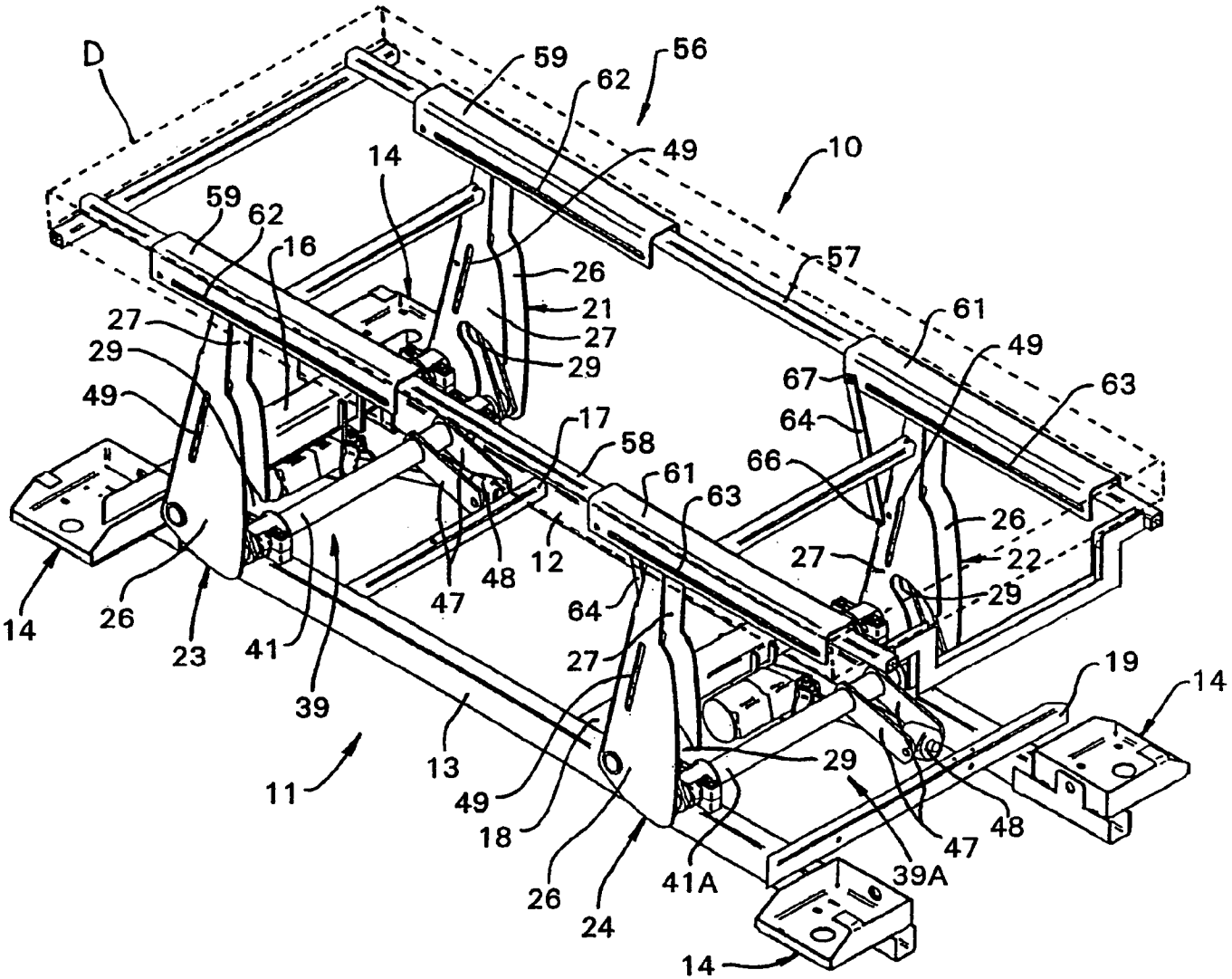
FIG. 1 is an isometric view of a frame elevating mechanism embodying the invention and illustrating the highest position of one frame relative to the other frame.

FIG. 1 illustrates a frame elevating mechanism 10 embodying the invention. The frame elevating mechanism includes a base frame 11 having a pair of elongate frame side rails 12 and 13 extending between a head end (left end) and the foot end (right end) thereof. Plural wheel supporting brackets 14 are provided and are each secured to a respective one of the frame side rails 12 and 13. Plural secondary frame rails 16, 17, 18 and 19 are connected to and extend between the frame side rails 12 and 13.

A pair of longitudinally spaced elongate lever arms 21 and 22 are mounted on the frame side rail 12. Laterally spaced therefrom there are provided lever arms 23 and 24 pivotally mounted on the frame side rail 13. The lever arms 21 and 22 are identically configured, namely, they have a generally U-shaped cross section having parallel legs 26 and 27 and an interconnecting bight 28 interconnecting the upper edges of the legs 26 and 27. The inside leg 27 of each lever arm 21, 22, 23 and 24 has a notch 29 formed therein.

Figure 2:
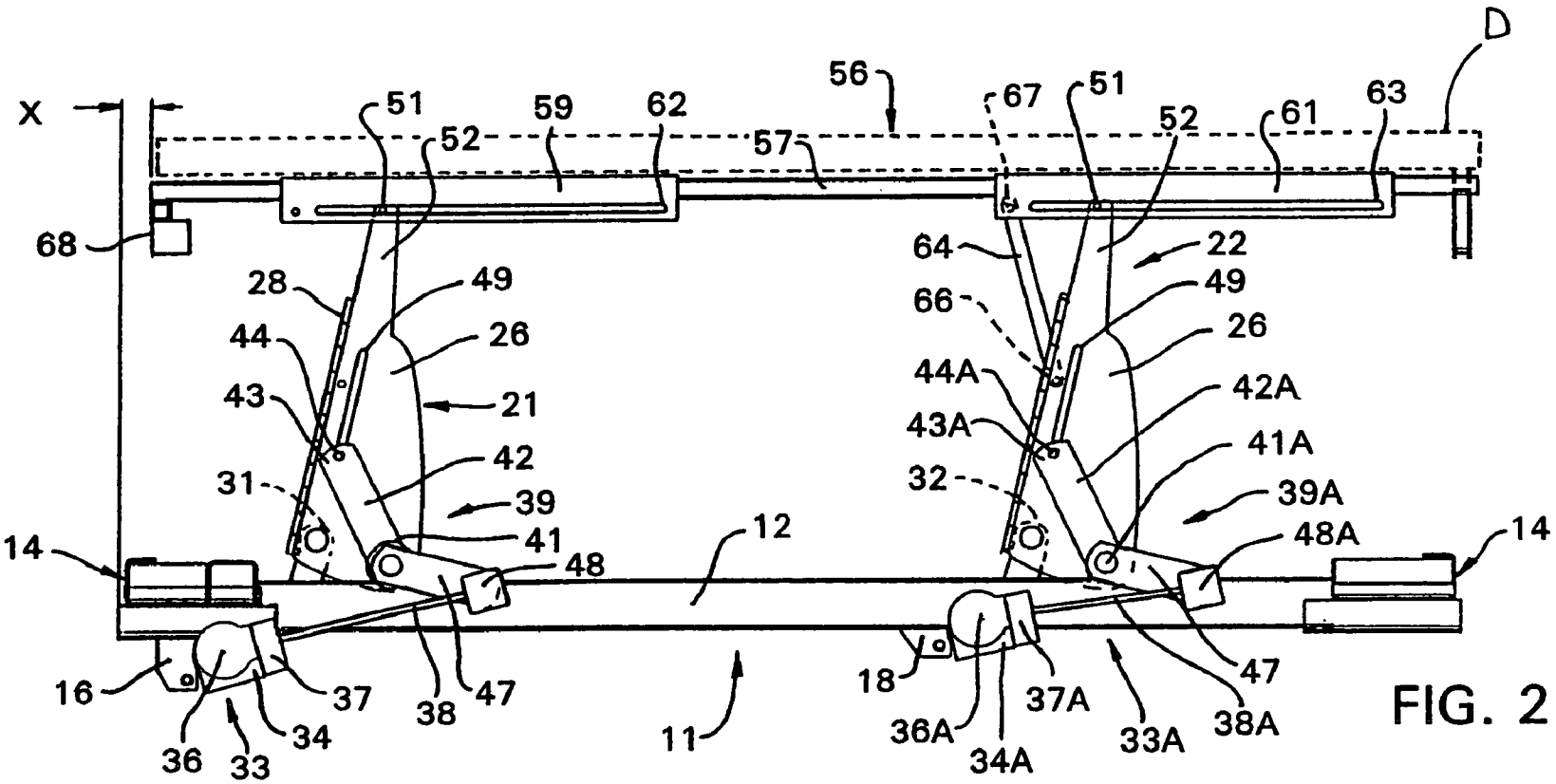
FIG. 2 is a sectional view of FIG. 1 taken along a length of one side of the frame elevating mechanism and parallel to a longitudinal center line of the illustration of FIG. 1.

As illustrated in FIG. 2, there are provided bearing blocks 31 and 32 at longitudinally spaced intervals along the length of the frame side rails 12 (also along the side rail 13). The bearing blocks 31 and 32 are configured to independently pivotally support the respective lever arms 21, 22, 23 and 24. In FIG. 2, the bearing blocks 31 and 32 respectively pivotally support the lever arms 21 and 22.

A drive mechanism 33 is secured to the secondary frame rail 16 and includes a frame 34 which is pivotally mounted to the secondary frame rail 16 and for movement about an axis that extends perpendicular to a vertical plane containing the longitudinal axis of the base frame 11. A motor 36 is mounted on the frame 34 and through a right angle drive transmission 37 has a rotatable output member 38. In this particular embodiment, the output member 38 is an externally threaded screw.

A similar drive mechanism 33A is mounted to the secondary frame rail 18 and since it is identical in its construction to the drive mechanism 33, the same reference numerals are designating the various componentry will be used, but have additionally the suffix "A" added thereto. Thus, further description of the drive mechanism 33A is believed unnecessary.

Each drive mechanism 33 and 33A is operatively coupled to a two arm lever 39 and 39A. Since the two two arm levers 39 and 39A are identical, only the two arm lever 39 will be described in detail, the same reference numerals will be used to identify identical componentry in the two arm lever 39A, but will have the suffix "A" added thereto.

The two arm lever 39 includes a shaft 41 rotatably secured to the upper side of the frame side rails 12 and 13 and extends therebetween. A first arm 42 of the two arm lever is actually composed of two laterally spaced first arms which are secured at one end to opposite ends of the rotatable shaft. The distal end 43 of the arms 42 each have a follower member 44 secured thereto.

Figure 3:
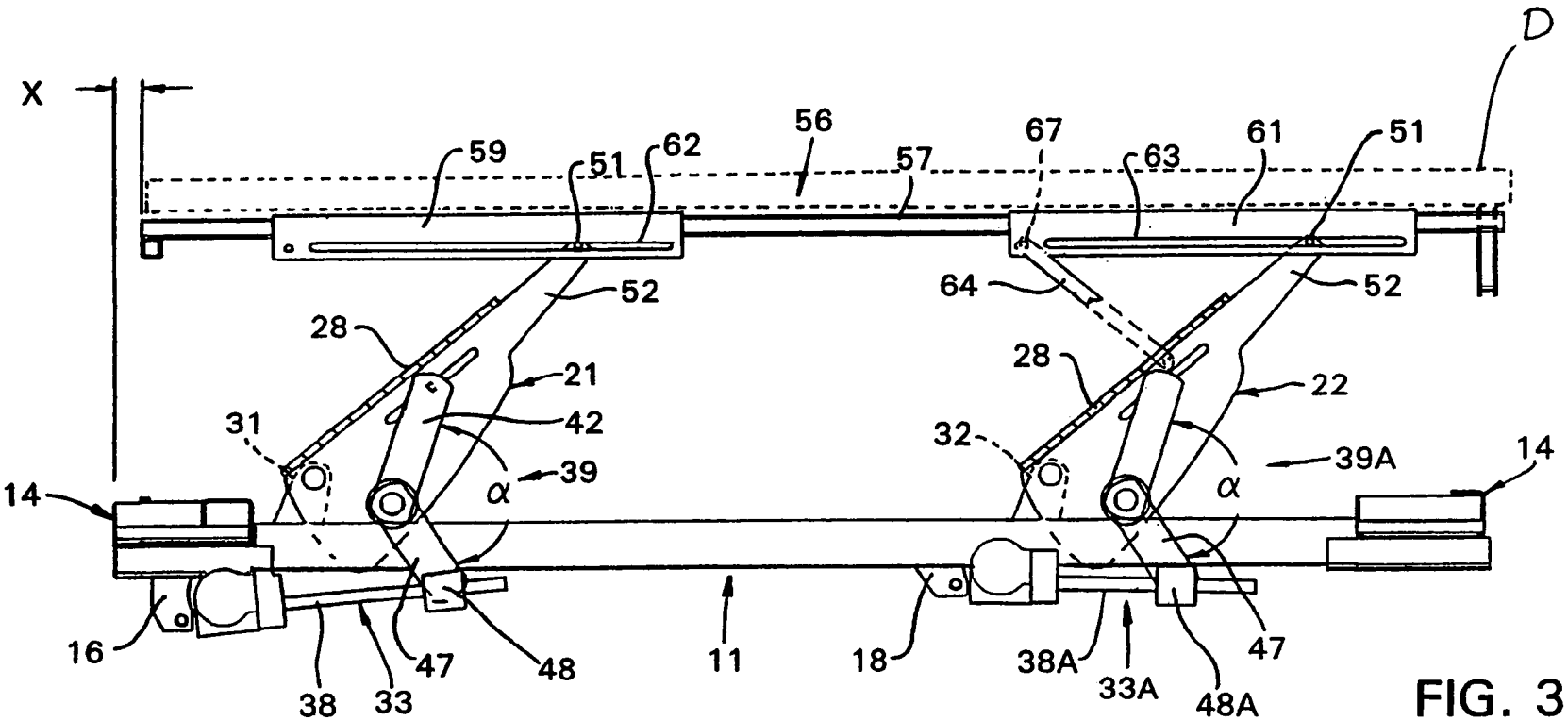
FIG. 3 is a sectional view similar to FIG. 2, but illustrating the uppermost frame at a mid-height level relative to the base frame.

A second arm 46 of the two arm lever 39 is actually two lever arms 47 extending at an angle a (FIG. 3) with respect to the first arms 42 and have oriented therebetween an internally threaded nut 48 which threadedly receives therein the elongate externally threaded screw 38. When the motor 36 is energized, the externally threaded screw 38 will rotate and the nut 48 will travel the length of the screw to effect a movement of the two arm lever 39 about the axis of the shaft 41.

Both legs 26 and 27 of the U-shaped lever arms 21 and 22 have an elongate slot 49 therein which is configured to receive therein and guide the aforesaid follower member 44 in response to movements of the lever arms 21 and 22 about the pivot support therefor. In this embodiment, the slots 49 are oriented in a plane that is parallel to a plane containing the bight segment 28. Further, a follower member 51 is secured to the distal end 52 of each lever arm 21 and 22.

The second or uppermost frame 56 is oriented directly above the base frame 11 so that the head end and the foot end are generally aligned with the foot end and head end, respectively, of the base frame 11. The upper frame 56 includes a pair of frame side rails 57 and 58 extending from the head end to the foot end of the upper frame 56. Each frame side rail 57 and 58 has a pair of longitudinally spaced elongate guide tracks 59 and 61 thereon. Each of the guide tracks 59 and 61 include an elongate slot 62 and 63, respectively, which receives therein the follower member 51 at the distal end 52 of each of the lever arms 21, 22, 23 and 24.

A finite length link 64 is connected to and extends between the lever arms 22 and 24 and one end of each of the guide tracks 61. In this particular embodiment, one end 66 of the link 64 is pivotally secured to a mid-length region of the lever arms 22 and 24 whereas the other end 67 is secured to a common one of the head end or foot end of the guide track 61.

OPERATION

Although the operation of the mechanism described above will be understood from the following description by skilled persons, a summary of such description is now given for convenience. It is assumed for this description of the operation that the upper frame 56 is elevated to its highest position relative to the base frame 11 and as illustrated in FIG. 1.

Figure 4:
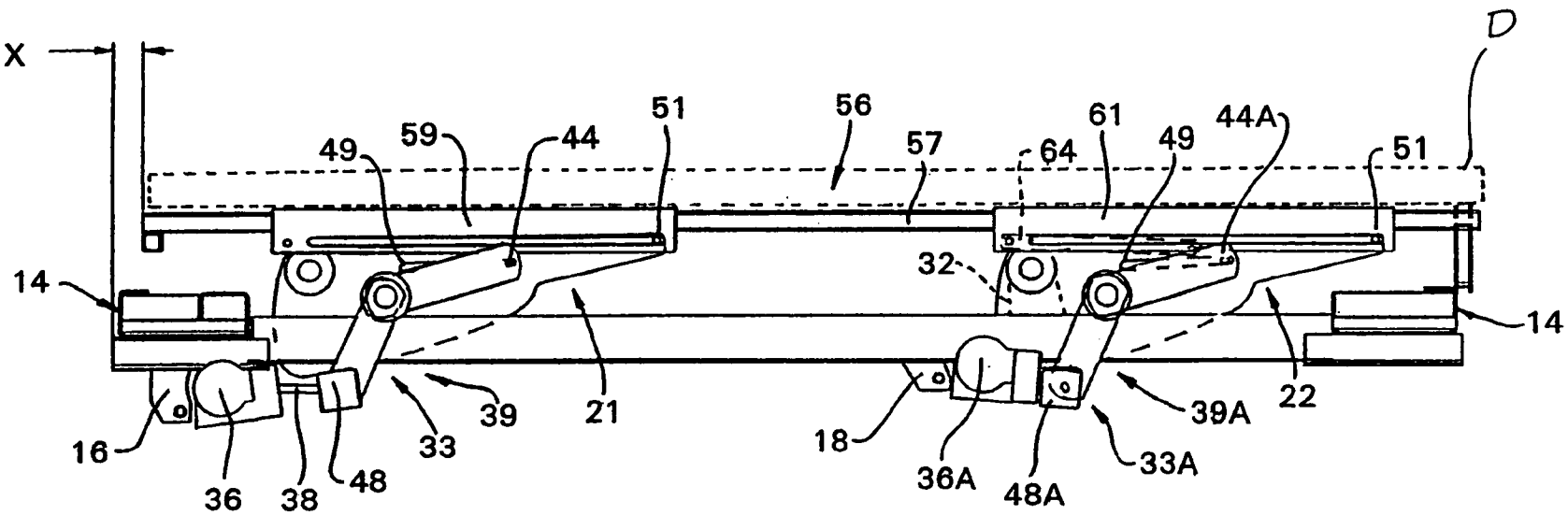
FIG. 4 is a sectional view similar to FIGS. 2 and 3, except that the uppermost frame is in its lowest position relative to the base frame.

Upon activation of a switch 68, electrical power obtained from either a wall socket through a power cord (not illustrated) that connects the frame elevating mechanism to the wall socket, or an onboard battery (also not illustrated) is selectively supplied to the motors 36 and 36A, in this case both motors, to effect a rotation of the respective output members 38 and 38A to cause the respective nuts 48 and 48A to travel along the length of the output members 38 and 38A, respectively, toward the respective motors 36 and 36A. This will cause the two arm levers 39 and 39A to rotate in a clockwise direction about the axis of the shaft 41 from the FIG. 2 position through the FIG. 3 position and thence to the FIG. 4 position. The lever arms 21, 22, 23 and 24 will each pivot about their respective pivotal supports 31 and 32 through the position illustrated in FIG. 3 and thence to the lowermost position illustrated in FIG. 4. During this movement, the follower members 44 and 51 will move along the length of the respective slots 49 and 62 and 63, respectively, to effect a vertical lowering of the upper frame 56 relative to the base frame 11. In order to keep the head end and the foot end of the upper frame 11 aligned with the head end and foot end of the base 11 and to maintain constant the dimension "X", the finite length link 64 prevents the upper frame 56 from moving toward or away from one of the respective head ends or foot ends of the frames 11 and 56. As stated above, FIG. 4 illustrates the lowermost position of the upper frame 56 relative to the base frame 11 and the respective follower members 44 and 51 are each oriented toward the common head end or foot end of the respective slots 49, 62 and 63. In order to elevate the upper frame to a higher position, the switch 68 is activated to reverse the motors 36 and 36A to cause a reverse operation.

When the frame 56 is in the position illustrated in FIG. 4, the notches 29 on the lever arms 22 and 24 receive therein the rotatable shaft 41A of the two arm lever 39A.

Figure 5:
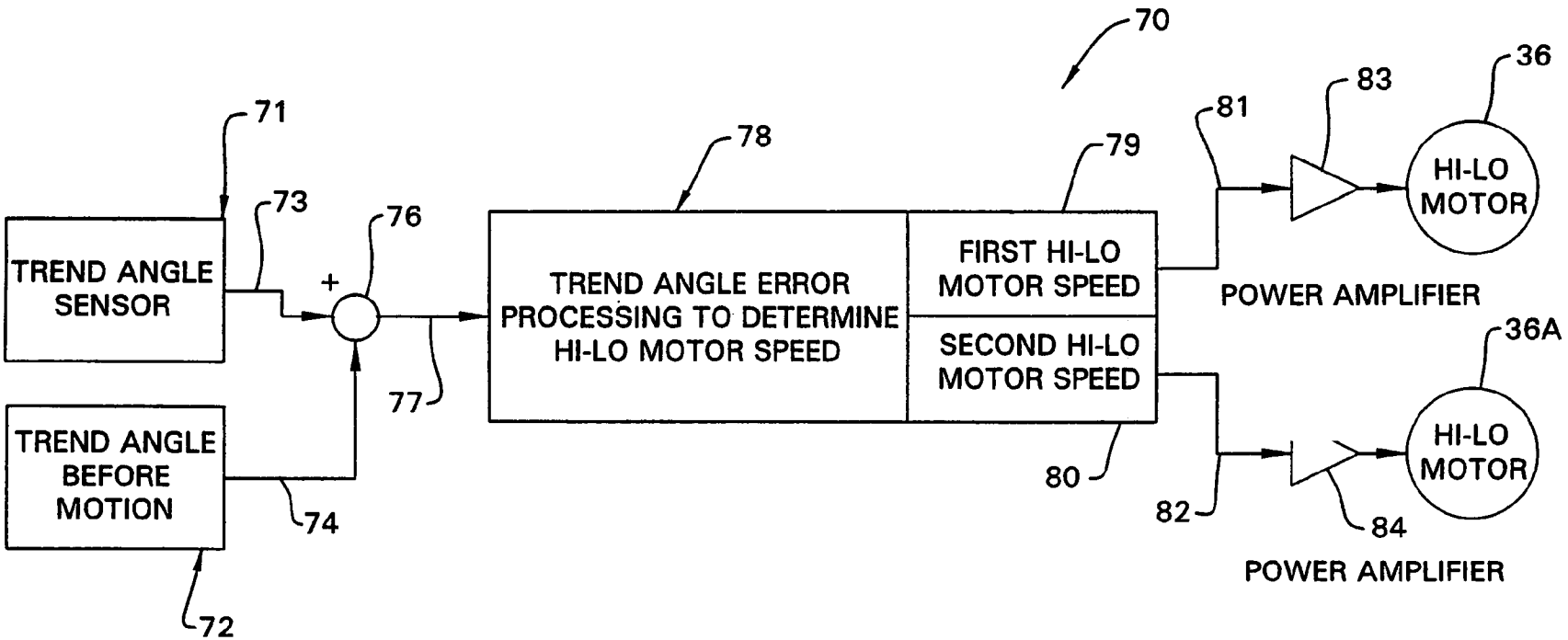
FIG. 5 illustrates a motor speed compensation circuit embodying the invention.

There will likely exist circumstances that will cause the speed at which the nuts 48, 48A travel along the length of the output members 38, 38A to differ. The difference in the speed can be attributable to different gear reducing ratios in the respective right angle drives 37, 37A and/or non-linearity in the elevating mechanism 10 and/or loads that are different at each end of the bed. Thus, I have provided a motor speed compensation circuit 70 illustrated in FIG. 5. The motor speed compensation circuit 70 includes at least one angle sensor 71 located at any convenient location on the upper frame 56 to provide an actual angle of inclination indication relative to horizontal. An angle store 72 is provided to store the angle value before a change in elevation is initiated. The respective outputs 73 and 74 from the actual angle sensor 71 and the angle store 72 are connected to a common node 76 which forms the input 77 to an angle processor 78.

The processor 78 contains and processes an algorithm that monitors the angle of the upper frame 56 and, when necessary, adjusts the relative speed of rotation of either one or both of the motors 36, 36A, also known as Hi-Lo motors, so as to maintain the appropriate angle for the upper frame 56. For example, and in this particular embodiment, the angle sensor 71 produces a linearly varying first signal which is compared to a stored second signal representative of the angle in existence prior to the initiation of a height change. The sum of the two signals at the node 76 will produce an input signal at 77 to the processor 78 which will then process the input signal to produce, in accordance with the algorithm, at least a first motor speed control signal at 79 for one of the motors 36 and, depending on the setup of the bed and algorithm used, a second motor speed control signal for the other motor 36A at 80. The first and second motor speed control signals are fed through respective outputs 81, 82 from the processor 78 through respective power amplifiers 83, 84 to the respective motors 36, 36A in order to effect a driving of the motors at the proper speed to maintain unchanged the angle, in existence prior to beginning the elevation change, throughout the change in elevation of the upper frame 56 relative to the base frame 11.

According to one embodiment of the present invention, motors 36, 36A have the same maximum rotational speed and are configured to initially operate at maximum capacity during initiation of a height adjustment (either raising or lowering) of the upper frame 56. Absent any load upon the upper frame 56, both motors 36, 36A will continue to operate at maximum capacity and will exhibit substantially equal rotational speeds, resulting in both ends of the upper frame 56 raising or lowering at the same speed, thereby maintaining the angle of the upper frame 56.

Typically, however, the upper frame 56 will be supporting a load, such as, for example, a person sitting or lying upon the patient support deck D. Furthermore, this load is frequently distributed unevenly across the frame 56 such that a first end of the frame 56 will be subject to a greater load than the opposite, second end of the frame 56. In this situation, initiation of a height change in the upper frame 56 results in both motors 36, 36A initially operating at their maximum capacity. However, due to the unevenly distributed load, the first motor (i.e., motor 36) at the first end of the frame 56 functions at a decreased rotational speed. As a result of this decreased rotational speed, the first end of the frame 56 raises or lowers at a slower rate than the opposite, second end of the frame 56, resulting in a change in the angle of the upper frame 56.

Processor 78 detects the change in the angle of the upper frame 56 by means of the angle sensor 71. The rotational speed of the second motor (i.e., motor 36A) at the second end of frame 56 is subsequently adjusted so as to substantially match the lower rotational speed of the first motor 36. In this manner, the rotational speeds of the two motors 36, 36A remain substantially matched during adjustments in the height of the upper frame 56, thereby allowing the angle of the frame 56 to be maintained.

To further illustrate the above process, consider the following example where a 200 lb person sits on the head end of the patient support deck. The head-end motor operates at its maximum capacity upon initiation of a height change in the frame 56, yet due to the 200 lb load at the head-end of the patient support deck, the rotational speed of the head-end motor decreases by 20% compared to when no load is present. Processor 78 detects the initial changes in the angle of the upper frame 56 and reduces the rotational speed of the foot-end motor by 20% so as to assure that both ends of the upper frame 56 raise or lower at the same rate. The head-end motor returns to its maximum, unloaded rotational rate upon removal of the 200 lb load from the head-end of the patient support deck. This increase in rotational speed in the head-end motor is detected as initial deviations in the angle of the upper frame 56, upon which the rotational rate of the foot-end motor is increased to match the rotational rate of the head-end motor.

Figure 6:
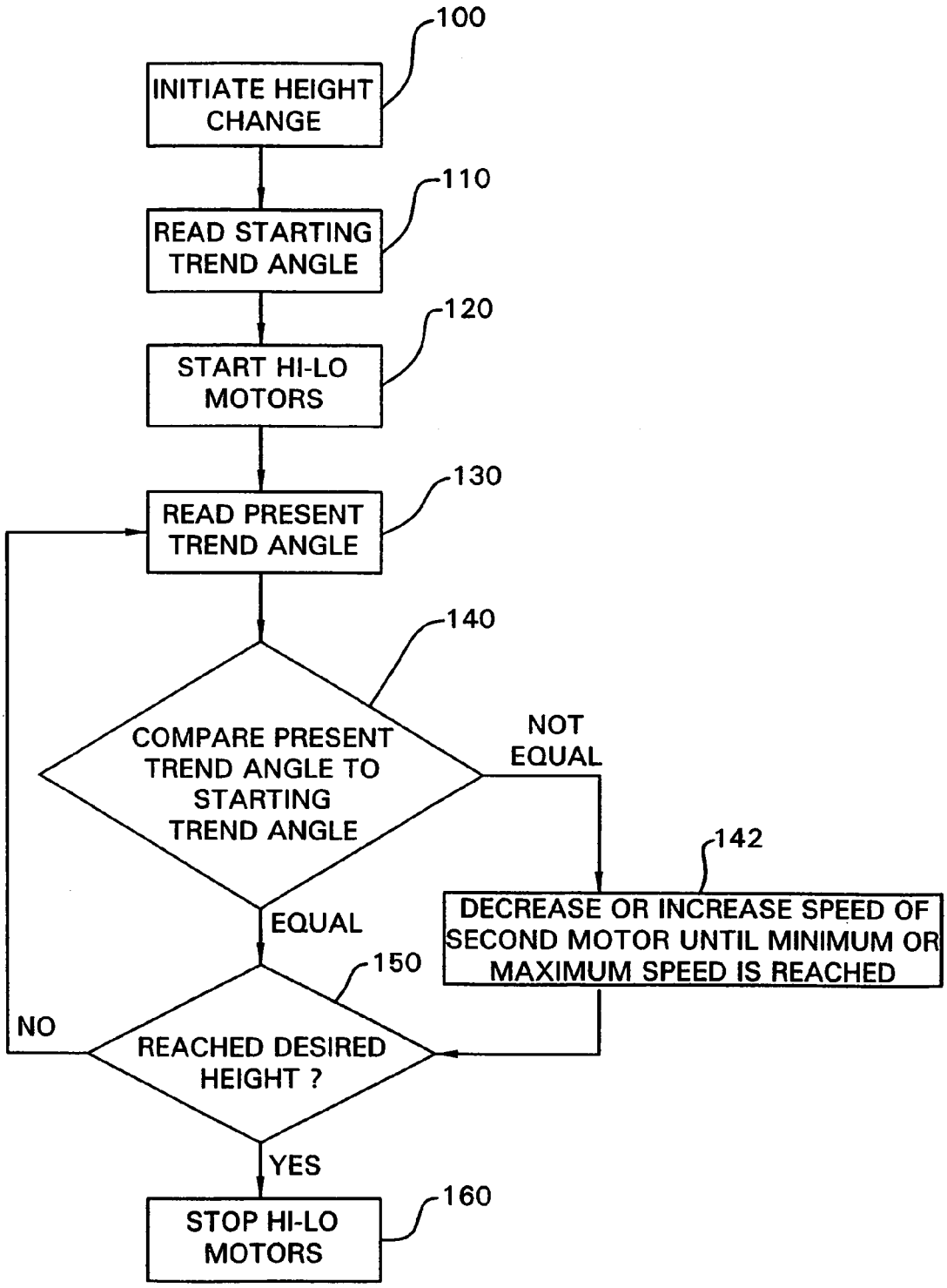
FIG. 6 is a flow chart of an algorithm utilized by said motor speed compensation circuit according to one embodiment of the invention.

To carry out the above example, processor 78 is programmed with one or more specific algorithms for monitoring and adjusting the angle of the upper frame 56. One example of such an algorithm is illustrated in the flow chart of FIG. 6. According to this illustrated algorithm of FIG. 6, the first step 100 involves the motor speed compensation circuit 70 receiving and initiating the appropriate procedure for changing the height of the upper frame 56. At step 110, the current angle of the upper frame 56 is determined by means of the angle sensor 71 and stored in the angle store 72. Both Hi-Lo motors 36, 36A are then activated in step 120. At step 130, the angle sensor 71 is then checked again to determine the current angle of the upper frame 56. A comparison of the current angle to the starting angle retained in the angle store 72 is then carried out at step 140. If the two angles are found to be equal, the algorithm proceeds on to step 150 to determine if the upper frame 56 has reached the desired height. If it is determined that the desired height has been achieved, both Hi-Lo motors 36, 36A are stopped, otherwise the algorithm loops back to step 130 and repeats. If it is determined at step 140 that the current angle is beginning to vary from the starting angle, the algorithm proceeds on to step 142 and, for example, decreases the rotational speed of the second motor 36, thereby causing both ends of the upper frame 56 to raise or lower at the same rate, thereby maintaining the angle of the frame 56

According to one alternative embodiment of the present invention, corrections to the angle during the raising or lowering of the upper frame 56 are achieved through adjustment of the rotational speed of the motor supporting the greatest load. Specifically, instead of decreasing the rotational speed of the motor subject to less load, the current embodiment increases the rotational speed of the motor supporting the greatest load. In this manner, the decreased rotational speed caused by an increased load is directly addressed by increasing the power output of the motor. However, unlike the previously described approach, the current embodiment requires that the motors 36, 36A be configured to run at less than maximum capacity when in an unloaded state.

Figure 7:
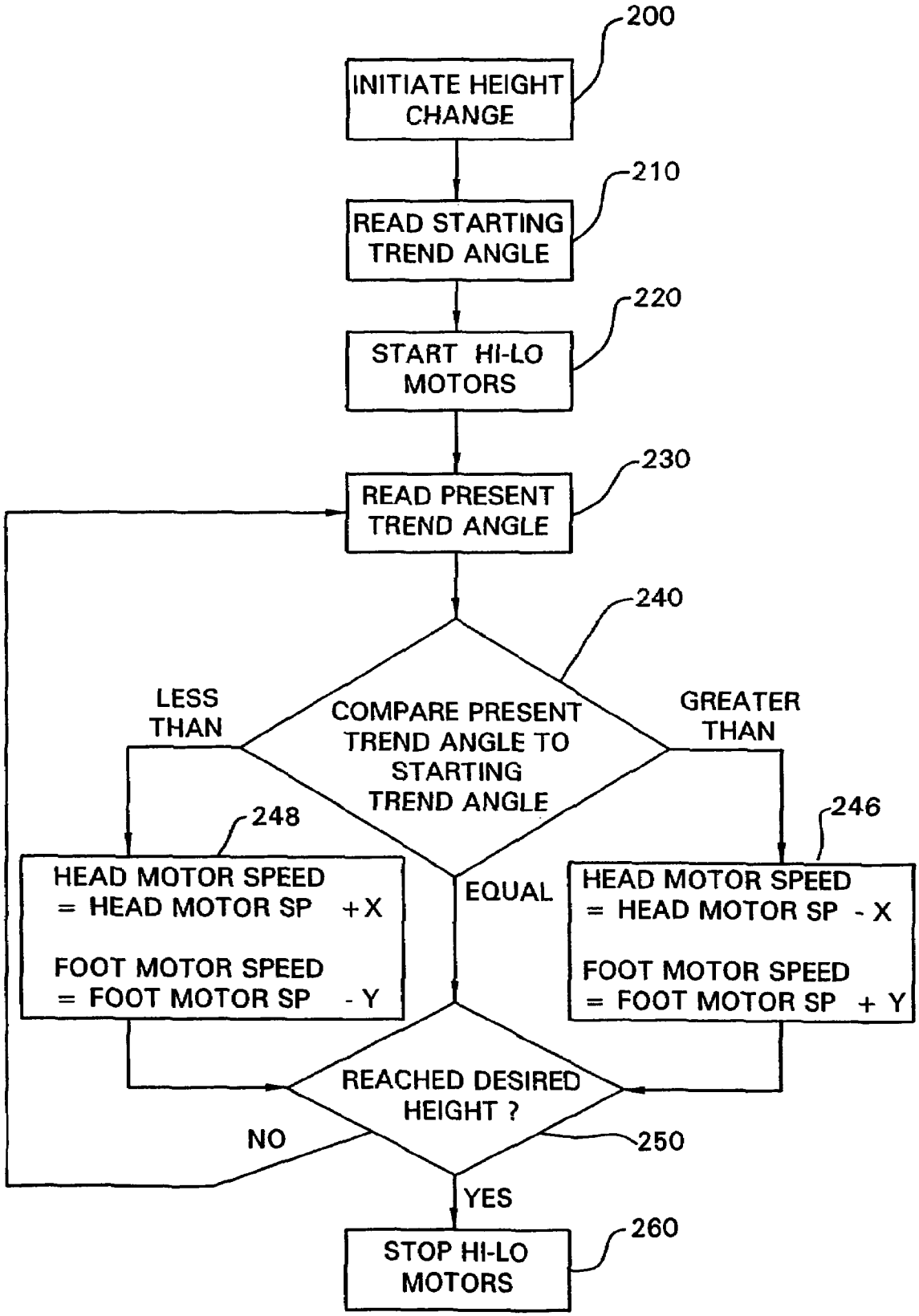
FIG. 7 is a flow chart of an algorithm utilized by said motor speed compensation circuit according to another embodiment of the invention.

According to another alternative embodiment of the present invention, corrections to the angle during the raising or lowering of the upper frame 56 are achieved through adjustment of the rotational speeds of both motors 36 and 36A. To accomplish such a task, an algorithm such as the one illustrated in the flow chart of FIG. 7 is carried out by the angle processor 78. Steps 200-240 and 250-260 are similar to the primary steps 100-140 and 150-160 required in the algorithm of FIG. 6, and as such, will not be discussed. However, according to the illustrated algorithm of FIG. 7, upon determining that the starting angle is greater than the current angle, the rotational speed of one of the motors (i.e., motor 36) is decreased while the rotational speed of the opposite motor (i.e., motor 36A) is increased. For example, as illustrated in the flow chart of FIG. 7, step 246 may require that the motor located at the head end of the bed unit be decreased by amount X, while the motor located at the foot end of the bed unit is increased by an amount Y, where X and Y represent either a specific amount of rotational speed, or, alternatively, a percentage of the current speed of the head end and foot end motors, respectively. Similarly, if the current angle is found to be less than the starting angle, step 248 can require that the rotational speed of the motor located at the head end of the bed unit be increased by an amount X, while the rotational speed of the motor located at the foot end of the bed unit be decreased by an amount Y. It should be understood that the above actions may need to be reversed depending on where the angle sensor 71 is located and how it is interpreted. For example, step 246 may instead require that the motor located at the head end of the unit be increased by an amount X, while the rotational speed of the motor located at the foot end of the unit be decreased by an amount Y.

In addition to the algorithms discussed above with reference to FIGS. 6 and 7, other equivalent motor control schemes can, if desired, be utilized. For example, instead of controlling motor rotational speed, one such scheme may call for the selective activation of motors 36 and 36*a*, thereby turning one motor on or off, prior or subsequent to the other motor, in order to correct for deviations in the angle of the upper frame 56.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A frame elevating mechanism, comprising:

a first frame configured to be supported on a floor surface;

a second frame oriented above said first frame and configured to be moveably supported by said first frame;

first and second drive mechanisms capable of operating at variable speeds for selectively adjusting an elevation of said second frame, with said first drive mechanism controlling an elevation of a first end of said second frame and said second drive mechanism controlling an elevation of a second end of said second frame, said first drive mechanism configured to initially operate at a first maximum operating speed and said second drive mechanism configured to initially operate at a second maximum operating speed that is substantially equal to said first maximum operating speed;

at least one angle sensor located on said second frame for determining an angle of inclination of said second frame; and a control unit for selectively controlling the elevation of said second frame;

wherein during a change in elevation of said second frame, said control unit repeatedly compares a starting angle of inclination of said second frame to a present angle of inclination of said second frame, and if not substantially equal, adjusts the operating speed of one of said drive mechanisms to compensate.

2. The frame elevating mechanism according to claim 1, further comprising a patient support deck at said second frame.

3. The frame elevating mechanism according to claim 1, wherein said control unit reduces the operating speed of said second drive mechanism to match the operating speed of said first drive mechanism in response to a weight being placed at said first end of said second frame, and wherein said control unit reduces the operating speed of said first drive mechanism to match the operating speed of said second drive mechanism in response to a weight being placed at said second end of said second frame.

4. The frame elevating mechanism according to claim 1, wherein during a change in elevation of said second frame, if the starting angle of inclination of said second frame is substantially equal to the present angle of inclination of said second frame, said control unit compares a present height of said second frame to a desired height of said second frame, and if the present height of said second frame is substantially equal to the desired height of said second frame, said control unit stops said first drive mechanism and said second drive mechanism.

5. The frame elevating mechanism according to claim 1, wherein each of said first and second drive mechanisms comprises a plurality of lever arms connected at and between said first frame and said second frame.

6. The frame elevating mechanism according to claim 5, further comprising a plurality of guide tracks at said second frame, wherein each of said lever anns is slidably connected at one of said plurality of guide tracks and pivotably connected at said first frame.

7. The frame elevating mechanism according to claim 6, wherein each of said first and second drive mechanisms comprises a motor adapted to pivot said lever arms with respect to said first frame.

8. A method of changing an elevation of a platform subject to an uneven distribution of load while maintaining an angle of inclination of said platform, comprising the steps of:

determining a starting angle of inclination of said platform by means of at least one angle sensor located on said platform;

activating first and second drive mechanisms configured to change an elevation of first and second ends of said platform, respectively, said first and second drive mechanisms configured to initially operate at substantially equivalent maximum speeds;

determining a present angle of inclination of said platform by means of said at least one angle sensor;

comparing said starting angle of inclination to said present angle of incination, and if not equal, adjust the speed of one of said drive mechanisms to compensate;

determine whether said platform has obtained a desired elevation;

repeat said determination of present angle of inclination step and comparing step until said desired elevation is obtained; and stopping said drive mechanisms upon obtaining said desired elevation.

9. The method according to claim 2, further comprising positioning a weight at said first end of said platform, wherein said adjusting the speed of one of said drive mechanisms to compensate comprises increasing the speed of said first drive mechanism to match the speed of said second drive mechanism.

10. The method according to claim 2, further comprising positioning a weight at said first end of said platform, wherein said adjusting the speed of one of said drive mechanisms to compensate comprises decreasing the speed of said second drive mechanism to match the speed of said first drive mechanism.

11. The method according to claim 2, further comprising adjusting the speed of both of said drive mechanisms to compensate.

12. The method according to claim 11, farther comprising positioning a weight at one of said first end and said second end of said patient support deck, wherein said adjusting the speed of one of said drive mechanisms to compensate comprises adjusting the speed of both of said drive mechanisms to compensate.

13. The method according to claim 11, further comprising positioning a weight at said first end of said platform, wherein said adjusting the speed of both of said drive mechanisms to compensate comprises increasing the speed of said first drive mechanism and decreasing the speed of said second drive mechanism.

14. A patient support comprising:

a base;

an upper frame oriented above said base and configured to be moveably supported by said base;

a patient support deck supported by said upper frame, said patient support deck having a first end and a second end, each of said ends having an elevation;

first and second drive mechanisms capable of operating at variable speeds for selectively adjusting said patient support deck relative to said base, said first drive mechanism controlling said elevation of said first end of said patient support deck and said second drive mechanism controlling said elevation of said second end of said patient support deck, said first drive mechanism configured to initially operate at a first operating speed and said second drive mechanism conligured to initially operate at a second operating speed that is substantially equal to said first operating speed;

at least one angle sensor located at said upper frame for determining an angle of inclination of said patient support deck; and a control unit for selectively controlling the elevation of said patient support deck, wherein during a change in elevation of said patient support deck, said control unit repeatedly compares a starting angle of inclination of said patient support deck to a pre-set angle of inclination of said patient support deck, and if not substantially equal, adjusts the operating speed of one of said drive mechanisms to compensate.

15. The patient support according to claim 14, wherein said first and second drive mechanisms are initially driven at a maximum capacity.

16. The patient support according to claim 14, wherein said control unit increases the operating speed of said second drive mechanism to match the operating speed of said first drive mechanism in response to a weight being placed at said second end of said patient support deck, and wherein said control unit increases the operating speed of said first drive mechanism to match the operating speed of said second drive mechanism in response to a weight being placed at said first end of said patient support deck.

17. The patient support according to claim 14, wherein said control unit increases the operating speed of said second drive mechanism and decreases the operating speed of said first drive mechanism in response to a weight being placed at said second end of said patient support deck, and wherein said control unit decreases the operating speed of said second drive mechanism and increases the operating speed of said first drive mechanism in response to a weight being placed at said first end of said patient support deck.

18. The patient support according to claim 14, wherein each of said first and second drive mechanisms comprises a plurality of lever arms connected at and between said base and said upper frame, and a motor adapted to pivot said lever arms with respect to said base.

19. The patient support according to claim 18, wherein said elevating mechanism further comprises a plurality of guide tracks at said upper frame, wherein each of said lever arms is slidably connected at one of said plurality of guide tracks and pivotably connected at said base.

20. A method of changing an elevation of a patient support deck subject to an uneven distribution of load while maintaining an angle of inclination of said patient support deck, said method comprising the steps of:

determining a first angle of inclination of said patient support deck supported at an upper frame by means of at least one angle sensor located at said upper frame;

activating first and second drive mechanisms configured to change an elevation of first and second ends of said patient support deck, respectively, said first and second drive mechanisms configured to initially operate at substantially equivalent speeds;

determining a present angle of inclination of said patient support deck by means of said at least one angle sensor;

comparing said first angle of inclination to said present angle of inclination, and if not equal, adjusting the speed of one of said drive mechanisms to compensate;

determining whether said patient support deck has obtained a desired elevation;

repeating said determination of present angle of inclination step and comparing step until said desired elevation is obtained; and stopping said drive mechanisms upon obtaining said desired elevation.

* * * * *

UNITED STATES PATENT AND TRADEMARK OFFICE

CERTIFICATE OF CORRECTION

PATENT NO. : 7,386,900 B2
APPLICATION NO. : 11/605126
DATED : June 17, 2008
INVENTOR(S) : Guy Lemire It is certified that error appears in the above-identified patent and that said Letters Patent is hereby corrected as shown below:

Column 7:
Line 43, Claim 6, “anns” should be --arms--.
Line 64, Claim 8, “incination” should be --inclination--.

Column 8:
Line 21, Claim 12, “farther” should be --further--.
Line 48, Claim 14, “conligured” should be --configured--.

Signed and Sealed this

Sixteenth Day of December, 2008

JON W. DUDAS
*Director of the United States Patent and Trademark Office*